United States Patent [19]

Glazener

[11] Patent Number: 4,535,512

[45] Date of Patent: Aug. 20, 1985

[54] METHOD AND MEANS FOR PROVIDING ASSEMBLAGES OF OPENED FIBERS FOR INTIMATE BLENDS

[75] Inventor: Carey A. Glazener, Pickens, S.C.

[73] Assignee: Platt Saco Lowell Corporation, Greenville, S.C.

[21] Appl. No.: 535,489

[22] Filed: Sep. 26, 1983

[51] Int. Cl.[3] ..... D01G 19/14

[52] U.S. Cl. ..... 19/229; 19/223; 19/304

[58] Field of Search ..... 19/229, 215, 115 R, 19/220, 221, 223, 224, 98, 304

[56] References Cited

U.S. PATENT DOCUMENTS

| | | | |
|---|---|---|---|
| 2,444,554 | 7/1948 | Crockett | 19/223 |
| 2,781,556 | 2/1957 | Foster | 19/223 |
| 3,154,817 | 11/1964 | Muenz | 19/98 |
| 3,479,699 | 11/1969 | Kaenel et al. | 19/223 |
| 3,727,270 | 4/1973 | Marshall | 19/304 |
| 3,793,679 | 2/1974 | Marshall | 19/304 |

FOREIGN PATENT DOCUMENTS

| | | | |
|---|---|---|---|
| 1213583 | 11/1970 | United Kingdom | 19/215 |

*Primary Examiner*—Louis K. Rimrodt
*Assistant Examiner*—Judith L. Kravitz
*Attorney, Agent, or Firm*—Donald H. Feldman

[57] ABSTRACT

Method and means for providing assemblages of fully opened and combed fibers for intimate blending with other staple fibers of a diverse type are disclosed, wherein combed tufts detached from preceding and succeeding tufts are moved in an air stream under subatmospheric pressure to a collection chamber. Movement by such an air stream assures that the parallelized fibers of the tuft are not disturbed but remain in a fully opened and combed condition for subsequent intimate blending. This method and means assure that the fibers are not bent, compressed or otherwise changed from their fully opened and combed state.

15 Claims, 2 Drawing Figures

METHOD AND MEANS FOR PROVIDING ASSEMBLAGES OF OPENED FIBERS FOR INTIMATE BLENDS

BACKGROUND OF THE INVENTION

Figure 1:
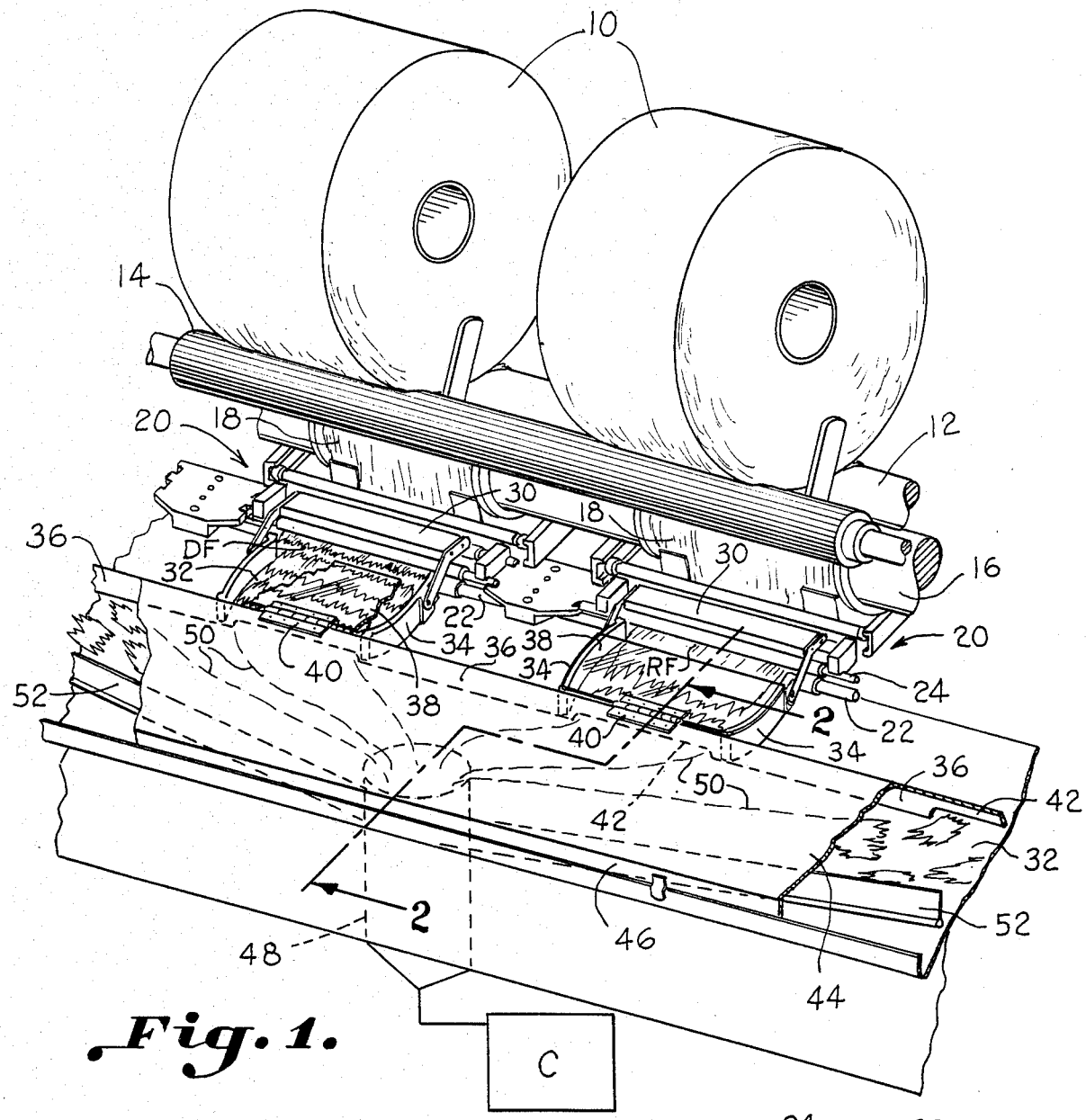

This invention relates to an improved method and means for providing well-opened assemblages of combed fibers for preparing what is known in the art as "intimate blends" of fibers of diverse types used to form superior yarns of high uniformity of composition of those fibers. Such assemblages of well-opened combed fibers usually are collected, baled, and processed through plucking, picking, blending through cleaners, chute feeds, and carding to provide the aforesaid blends, usually far superior in uniformity of composition than can otherwise be attained through several stages of drawing blending operations.

While it had been written, " . . . neither shall a garment of linen and woollen come upon thee . . . " (Leviticus 19:19d) and "Thou shall not wear a garment of diverse sorts, as of woollen and linen together." (Deuteronomy 22:11), these admonitions for various reasons are believed to be no longer applicable, leading to a technology of combining fibers of diverse sorts, whether as initially as alternate yarns of different fiber types, or as more recently by combining fibers of diverse types in the very same elongate yarn strand, and even more recently to do that in what has become known as intimate blending, as is described above.

The end desired result of intimate blending is to provide a spinnable mixture of fibers of diverse sorts, such as cotton and polyester for example, of such uniformity in composition and processing characteristics as to be as though one were indeed processing but a single uniform fiber type staple fibers of very high quality.

Impetus for innovation regarding intimate blending has been provided by the commercial yarn mills themselves. On their own they determined the desirability of rebaling combed sliver and introducing the combed fibers once again at the bale plucker line for mixing a fiber stock of diverse fiber types for processing to form single yarn blended strands. They determined that this means was vastly superior for their needs than the blending of diverse fiber strands at the draw box, for example, or by blending of clumps of diverse fiber types using chute feed methods. Yet despite these and other advances urged, developed and used by the mills, certain disadvantages persisted in such intimate blends.

One of these disadvantages showed up in the yarns produced. They formed within each single strand of diverse fibers admixtures a yarn which showed perceptable nonuniformities in mixture percentages from length to length therealong and or in nonuniformities in comparisons of cross-sectional qualities from one cross-section to another. There still persisted significant variations in any sample from the theoretical blend composition and thus in yarn properties from length to length therealong and from one yarn to the next formed from the same fiber mix.

Another disadvantage which became apparent was in the less than complete randomness of distribution of the constituent types of fibers in the yarn product. This would reflect itself sometimes in a showing of the above described nonuniformities, but also would be evident where more delicate properties of the yarn became important, such as in critical uniformity and trueness of coloration of the yarn strands when dyed or tinted.

A further disadvantage was evident regarding the economics of the use of a combing machine of high capital expense to provide a rebaled stock albeit of high quality and unit value.

Thus, it was to the assuage of these problems that the present invention was devised, to mitigate the disadvantages then in the art in a substantially simpler and less expensive manner than was hitherto known.

OBJECTS OF THE INVENTION

It is an object of the invention to provide less expensive means for producing fully opened assemblages of fibers and collecting the same as such for preparing intimate blends thereof, which means is even more effective than by those hitherto known.

Another object of the invention is to provide a method for producing such assemblages of fibers, and collecting the same for subsequent rebaling in a yet less expensive manner than was hitherto known.

Further desirable objects and advantages of this invention will be made evident through the explanations and examples which follow.

SUMMARY OF THE INVENTION

In the process of this invention, the critical steps include a. Separating a tuft of staple fibers from a mass thereof;
b. Then combing the forward portion, or a portion of the tuft adjacent an end thereof while keeping the tuft stationary;
c. Then combing the rearward portion, or the remaining portion of the tuft towards the other end thereof by advancing the tuft through the comb in a direction so that the first mentioned end leads;
d. Then advancing the now combed tuft to a collection area or space;
e. And, then collecting the combed tuft in its fully opened and combed state.

According to the present process, collecting is most felicitously effected by vacuum drawing off of the tuft.

In the foregoing, it is important to note that any condensing or compressing of the fibrous arrays following combing is avoided, unlike prior art methods wherein the arrays are repieced or reattached to form a diaphanous combed sliver web which is then compressed or condensed to form a sliver strand. The combed and fully opened tufts provided as above may range in length from leading to trailing ends from one to one-and-a-half staple lengths.

In another embodiment, using, for example, a traditional comber to perform the steps of the invention, one may arrange the settings in such a manner that while repiecing, or reattaching of sequential tufts occurs it occurs so that the piecings or attachments are quite weak, weak enough so that upon the application of vacuum in the "collecting" step the piecings or attachments part providing once again the separated fully opened and combed tufts, or "fringes." In conventional combing, every effort is exerted to make the piecings or reattachments from tuft to next tuft as uniform and as strong as the overlapped fibers within the tufts themselves. According to this invention, we seek the opposite, to make the piecings and reattachments weak, or non-existent.

Apparatus of the invention comprises means for combing a first portion of a fibrous tuft while keeping the tuft substantially stationary, means for combing the remainder of the tuft and for advancing the tuft in a direction wherein the first portion is the leading portion, and means for collecting a plurality of said tufts in a substantially open and non-condensed condition for further processing to form intimate blends of fibers of diverse types for making yarns of superior uniformity and quality.

DRAWINGS

Figure 2:
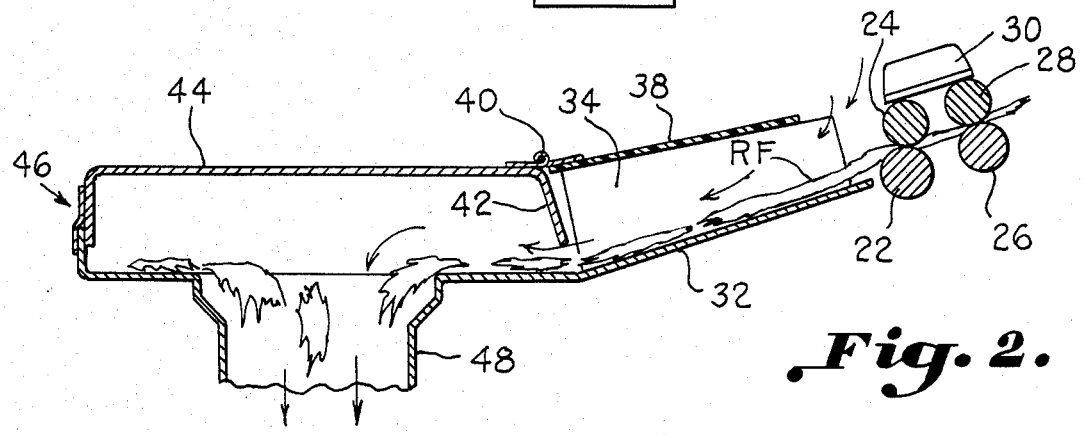

The present invention may be better understood by reference to the descriptions which follow of the preferred embodiment when taken in conjunction with the appended drawings, in which:

FIG. 1, a fragmentary perspective view taken in front elevation, partially diagrammatic and with portions broken away for better clarity of understanding, shows two "deliveries" of a combing, advancing and tuft collection apparatus of the invention illustrating the various means thereof; and FIG. 2, in section of a side elevation of the apparatus taken substantially along lines 2—2 of FIG. 1, shows an array of tufts being moved in a typical flow path from the delivery rolls of the combing and advancing means to and through the present collection means.

EMBODIMENT

With reference to the drawings, the combed tufts or fringes DF (at the left-hand delivery) and RF (at the right hand delivery) in FIG. 1 and RF in FIG. 2, are advanced by roller pairs 22,24 and 26,28 from that portion of the apparatus wherein the tufts DF and RF were combed onto table portion 32 of the present means for collecting the tufts. Table 32 is provided with a smooth surface so as not to impede the movement of fringes DF and RF thereacross. A source of vacuum is interconnected with a collection chamber both collectively designated "C", and draws air thereinto via tubes diagramatically shown as lines extending between entry channel 48 and the chamber and vacuum source C. In turn, air is drawn from the ambient atmosphere by the openings at each delivery between the delivery roller pair 22,24 and a hood cover plate 38. Plate 38, shown to be formed of a transparent material, in turn is connected with and as a part of an overlying top plate 44 by means of a hinge 40. The air thus is drawn and moves through the channel provided between table 32 and plate 38 as its bottom and top and between side guide walls 34, past baffle flange 42 and into the plenum defined between top plate 44, table 32 as the top and bottom, and end flanged joinings of plate 44 and table 32, generally designated 46. Depending upon the length of the apparatus, and the strength of the under pressure or vacuum pulled within the aforesaid plenum, from collection chamber and vacuum source C the apparatus may contain one or a plurality of entry channels 48; for illustration, only one is shown. For guidance of tufts DF and RF towards and into entry channel 48, under the aegis of the currents of air shown by arrows in FIG. 2, guide plates 52 are provided within the plenum of the present collecting means. Plates 52 help prevent the accumulation of tufts in the space on table 32 between joined flanges 46 and entry channel(s) 48, which may prevent their being conveyed to the collection chamber C. The flow paths for the various tufts being moved toward the orifice of entry channel 48 from the various deliveries, generally designated 20, is shown in FIG. 1 by the dashed boundry lines marked 50.

The preferred embodiment is shown in FIG. 1 at the left hand delivery 20, wherein tufts DF (detached fringes) are formed and conveyed or advanced to the collection means and therethrough to chamber C for then subsequent baling and processing to yarn. Combed tufts DF are formed by processing a lap 10 of fibers through a combing device of conventional design and construction, such as is described in the July 1974 edition of the publication *SACO-LOWELL BULLETIN.* Vol. 42, No. 1, pages 4 through 25. That description is included herein by reference, the exact construction of such a suitable combing means being immaterial to the practice of the present invention. At any event, as shown, lap 10 of fibers is received between the pair of power driven creel lap rollers 12,14, and is threaded about the rear of roller 12 and then downwardly over the frontwardly facing periphery of a nipper rocker shaft 16 and into a combining mechanism generally designated 20, the mechanical components of which are not shown. The fiber mat or lap 18 unrolled from the lap roll 10, in a common such combing mechanism, after passing over the periphery of shaft 16 may be passed through a nipper assembly including a top comb, a nipper knife, combing cylinder coacting with a half-lap cleaning brush and then is moved through the nip between two sets of otherwise abutting rollers, which may be called delivery rollers, such as rollers 22,24 in FIGS. 1 and 2, or detaching rollers pairs 26,28 and 22,24 as shown in FIG. 2. Once the beard of fibers at the leading edge of lap 18 has been combed substantially free of foreign matter and short or immature fibers by the top comb and combing cylinder it is received by the aforesaid roller pairs 26,28 and 22,24 and forwarded by them onto table 32 as shown. Within the combing means 20, the successive beards of fibers at the leading edge of lap 18 are detached from the succeeding then newly formed leading edge beard fibers to form tufts or fringes DF of combed fibers, and appear as such discrete detached tufts DF on table 32.

In another embodiment, with special reference to the right hand portion of FIG. 1 and to FIG. 2, while as in the left hand portion of FIG. 1 successive beards of fibers at the leading edge of lap 18 are detached from the succeeding then newly formed leading edge beard fibers, the discrete detached tufts are then overlapped in a manner similar to that of any ordinary combing machine but in such a way as to provide less dense overlapped portions or weakly reattached portions between successive beards of fibers removed from the leading edge of lap 18. Thus, when the web of weakly reattached fiber tufts RF are moved onto table 32 by rollers 26,28 and 22,24, and then come under the influence of drafts or currents of air being pulled by the aforesaid vacuum source at C, fiber tufts RF are parted one from another then to form discrete tufts RF while being moved toward entry channel 48 and into collection chamber C as shown.

Critical to the present process and to apparatus used to prepare and collect fiber tufts DF and RF, which are fully opened and combed assemblages of fibers, is to assure that the fibrous assemblages once yielded up by the combing mechanism are not condensed, or squeezed until they are removed from the collection chamber for baling. Thus, one would avoid forming a ribbon or sliver or rope of the fibers, or otherwise compact them as by running them through a condenser such as a trumpet. The object here is to prevent as much as possible fiber fold-overs and intertwinings, and end hooks or the like which would in any way provide for an impediment to the complete and intimate mixing and blending of fibers of diverse types in subsequent blow-room operations. The above described method and means of this invention uniquely, simply and inexpensively provide such critical conditions which assure the obtaining of a fibrous product suitable for preparation of high quality and very uniform intimate blends of fibers of diverse types.

While it is said that baling may follow collection of tufts DF and RF, this practice is not always followed. In some mills it is believed that opened and combed tufts such as DF and RF are mixed by "weigh-pan" methods, fed to chutes and then directly to the cards for further information into yarns.

In practice of this invention, variations from what has been described are possible and yet fall within the purview thereof. For example, in the combing step(s), one may if one could devise appropriate combing apparatus therefor first comb a portion of the tuft while either holding it stationary or advancing it and then comb the remainder of the tuft while holding it stationary, three possible variations beyond what was previously described to provide the desired fully opened and combed tuft(s) DF and or RF for conveyance according to the invention by means which would not change this state.

I claim:

1. Improved means for providing fully opened, combed, discrete and non-condensed assemblages of staple fibers for subsequent blending in admixture with other such assemblages of staple fibers of diverse type thereto, then to produce intimate blends of such fibers of diverse types and, upon yet further processing, elongate strands or yarns which have uniquely uniform admixture compositions, said means comprising:

a. separating and combing means
   for separating a discrete tuft of fibers from a mass thereof and
   for combing said tuft to remove impurities, foreign matter and immature fibers therefrom and to align its contituent fibers into an orientation substantially axially parallel one another while maintaining the same in a substantially non-condensed state;
b. fiber tuft engaging, advancing and disengaging means
   for engaging said tuft as a discrete entity in a substantially non-condensed state,
   for advancing said fully opened, combed, discrete, non-condensed tuft in a direction substantially parallel to that of the axial orientation of its constituent fibers, and then
   for disengaging said tuft as a discrete entity; and
c. fiber tuft receiving, conveying and collecting means
   for receiving said disengaged combed tuft as a discrete entity and in a substantially non-condensed state, and like preceding and succeeding ones thereof, individually as discrete entities,
   for conveying said tufts as discrete entities while maintaining said tufts in a substantially non-condensed state during said conveying, and
   for collecting said conveyed, non-condensed tufts as discrete entities; and
d. wherein said fiber tuft receiving, conveying and collecting means includes means for providing currents of air to receive said tufts disengaged by said disengaging means, to convey said received tufts to a collection chamber and there to collect said conveyed tufts in a substantially non-condensed state.

2. Improved means as in claim 1, wherein said means for providing currents of air is a source of vacuum pulling said currents toward and into said collection chamber.

3. Improved means as in claim 1, wherein said means for receiving, for conveying and for collecting includes an enclosed passageway duct means for receiving and guiding said currents of air and said disengaged tufts carried thereby to and into said collection chamber at one end thereof in a manner such as to maintain said tufts in a discrete and non-condensed state.

4. Improved means as in claim 3, wherein said enclosed passageway duct means includes an entry plenum at another end thereof through which said duct means receives said disengaged tufts and said currents of air from the ambient atmosphere.

5. Improved means as in claim 4, wherein said entry plenum is in part defined by an underlying smooth surface extending from said tuft engaging, advancing and releasing means to a tube interconnecting said plenum with said collection chamber.

6. Improved means as in claim 5, wherein said entry plenum is further defined by an overlying smooth-surfaced support member.

7. Means as in claim 6, wherein at least a portion of said overlying support member is transparent.

8. Means as in claim 4, wherein said plenum is defined in part by side members, an overlying support member and an underlying support member, said underlying support member being bound by a plenum-defining surface which is smooth and being joined to said overlying support member by said side members, to form in all an elongate duct portion to define said plenum.

9. Means as in claim 8, wherein said plenum contains therewithin and fixed between said overlying and underlying support members guide means including guide members secured between said overlying and underlying support members for guiding said currents of air within said plenum and said tuft carried thereby from said means for releasing said tuft to interconnecting portions of said duct and said collection chamber.

10. Means as in claim 8, wherein at least a portion of said overlying support member is transparent.

11. Means as in claim 8, wherein at least a portion of said overlying support member is hinged.

12. An improved method for providing fully opened, combed, discrete and non-condensed assemblages of staple fibers for subsequent blending in admixture with other such assemblages of staple fibers of a diverse type thereto, to produce intimate blends of such fibers of diverse types upon yet further processing into elongate strands or yarns which have uniquely uniform admixture compositions, comprising the steps of a. separating a discrete tuft of staple fibers from a mass thereof;
b. combing said tuft in order to remove therefrom impurities, foreign matter and immature fibers and in order to align its constituent fibers into an orientation substantially axially parallel one another and in a fully opened substantially non-condensed state;
c. engaging, advancing and releasing said fully opened, combed, non-condensed tuft in order to engage said tuft, to advance said tuft in a direction substantially parallel to that of the axial orientation of its constituent fibers, and then to disengage said discrete combed tuft; and d. receiving, conveying and collecting said disengaged combed tuft and like preceding and succeeding ones thereof, individually as discrete entities, while maintaining said tufts in a substantially non-condensed state during said receiving, said conveying and said collecting.

13. An improved method as in claim 12, wherein said releasing includes detaching said discrete tuft from any preceding or succeeding tuft.

14. An improved method as in claim 13, wherein said detaching is effected at least in part by streaming currents of air by said tuft.

15. An improved method as in claim 14, wherein said receiving, conveying and collecting of said tufts are effected by streaming currents of air by said tufts at a subatmospheric pressure in a direction for said collecting.

* * * * *